US009308580B2

(12) United States Patent
Stebbing

(10) Patent No.: US 9,308,580 B2
(45) Date of Patent: Apr. 12, 2016

(54) STRESS FREE STEEL AND RAPID PRODUCTION OF SAME

(71) Applicant: Rex Enterprises, LLC, Norfolk, NE (US)

(72) Inventor: Franklin Leroy Stebbing, Norfolk, NE (US)

( * ) Notice: Subject to any disclaimer, the term of this patent is extended or adjusted under 35 U.S.C. 154(b) by 144 days.

(21) Appl. No.: 14/040,997

(22) Filed: Sep. 30, 2013

(65) Prior Publication Data

US 2014/0027082 A1 Jan. 30, 2014

Related U.S. Application Data

(63) Continuation of application No. 12/912,377, filed on Oct. 26, 2010, now Pat. No. 8,545,645, which is a continuation-in-part of application No. 10/993,096, filed on Nov. 19, 2004, now abandoned.

(60) Provisional application No. 60/526,243, filed on Dec. 2, 2003.

(51) Int. Cl.

| | |
|---|---|
| ***B22D 11/00*** | (2006.01) |
| ***B22D 27/08*** | (2006.01) |
| ***B21D 3/00*** | (2006.01) |
| ***C21D 1/84*** | (2006.01) |
| ***C21D 10/00*** | (2006.01) |
| *B21B 1/08* | (2006.01) |
| *B21B 1/18* | (2006.01) |
| *B21B 1/22* | (2006.01) |
| *B21B 1/46* | (2006.01) |
| *B21B 11/00* | (2006.01) |
| *B21B 39/00* | (2006.01) |
| *C21D 1/04* | (2006.01) |
| *C21D 1/30* | (2006.01) |
| *C21D 7/13* | (2006.01) |

(52) U.S. Cl.
CPC *B22D 27/08* (2013.01); *B21D 3/00* (2013.01); *C21D 1/84* (2013.01); *C21D 10/00* (2013.01); *B21B 1/08* (2013.01); *B21B 1/18* (2013.01); *B21B 1/22* (2013.01); *B21B 1/46* (2013.01); *B21B 11/00* (2013.01); *B21B 39/002* (2013.01); *C21D 1/04* (2013.01); *C21D 1/30* (2013.01); *C21D 7/13* (2013.01)

(58) Field of Classification Search
CPC ..... B22D 11/051; B22D 11/114
USPC ..... 164/459, 416
See application file for complete search history.

(56) References Cited

U.S. PATENT DOCUMENTS 4,457,356 A * 7/1984 Hasebe et al. ..... 164/478

(Continued)

*Primary Examiner* — Scott Kastler
(74) *Attorney, Agent, or Firm* — Banner & Witcoff, Ltd.

(57) ABSTRACT

A method of producing steel with reduced internal stress concentrations is disclosed. In an embodiment, hot steel is shaped by a rolling mill. The resultant steel product is bundled as soon as practicable and the bundle is allowed to cool. Vibration energy is applied to the bundle of steel product so that internal stress concentrations within the steel product are relieved. In an embodiment, a plurality of bundles are stored on a rack and the rack is vibrated, the vibrations being transmitted to the plurality of bundles so that undesired internal stress concentrations within the steel products are relieved. Alternatively, magnetics may be used to relieve the undesired internal stress concentrations within the steel products. Thus, improved steel is produced as well as improved steel that can be produced more rapidly than known techniques.

14 Claims, 14 Drawing Sheets

(56) References Cited

U.S. PATENT DOCUMENTS 4,662,427 A * 5/1987 Larrecq et al. ..... 164/416
5,355,935 A * 10/1994 Nogues ..... 164/416
5,915,458 A * 6/1999 Pavlicevic ..... B22D 11/053 164/416
6,523,601 B1 * 2/2003 Hury et al. ..... 164/416
2007/0215311 A1 * 9/2007 Motegi et al. ..... 164/459

* cited by examiner

STRESS FREE STEEL AND RAPID PRODUCTION OF SAME

CROSS-REFERENCE TO RELATED APPLICATIONS

This application is a continuation application to U.S. Ser. No. 12/912,377, filed Oct. 26, 2010, now U.S. Pat. No. 8,545,645, which is a continuation-in-part application to U.S. Ser. No. 10/993,096, filed Nov. 19, 2004, now abandoned, which claims priority to U.S. Provisional Application Ser. No. 60/526,243, filed Dec. 2, 2003, now expired.

BACKGROUND OF THE INVENTION

1. Field of the Invention

The present invention relates to the field of production of steel, more specifically to a method of making steel with reduced internal stress concentrations.

2. Description of Related Art

Methods for ferrous metallurgy are known, perhaps the most common method being the production of steel. Typically, iron ore and other various raw materials such as coke, limestone and dolomite are heated in a blast furnace to a sufficient temperature to melt the raw materials and allow them to mix. Slag is separated from the mixture and the remaining molten metal is transferred to a steel melting shop where further refining is done. The resultant crude steel can then be further refined with the addition of alloys that give the particular steel the desired properties. As is known, some of the above processes can be supplemented with the inclusion of scrap steel or iron. The resultant product is typically continuously cast into billets, blooms or slabs, sometimes referred to as "semis", and these semis are then processed to form the final product. In some plants the product is cast directly into strip on strip casters. In others, the semis can be beam blanks or near-net-shapes to reduce rolling requirements.

During the processing of semis, the semis are typically heated to a temperature sufficient to allow the semis to be worked, a typical such temperature being 1200 degrees Celsius. The semis are then processed by a rolling mill, the design of the rolling mill dependent on the desired shape of the finished product. The rolling mill, through the application of heat and pressure, forms the steel product. Thus, significant energy is used to shape the semis into the steel product.

Steel product, in a final form, can be a variety of shapes and configurations. Steel product includes, for example, flat rolled steel, steel strip, bars, beams, wires, rods, sheets, plates, bands, channels, tubes, pipes, tracks, and rails. If the steel product is a bar or a beam, for example, it may be stored in bundles. When steel product is shaped into flat rolled steel, for example, it is often rolled into round coils. Steel product, when shaped into wire or rod, for example, is also often typically rolled into round coils. For ease of reference, coils of steel product will also be referred to as bundles unless otherwise noted.

In general, there is a significant desire that the steel being produced have relatively constant dimensional straightness. Thus, significant resources are exerted in controlling the rolling mill process so that the finished product has the correct dimensions and straightness. Steel product with poor dimensional straightness control must be either sold at a lower cost, be reworked, or be reprocessed. The designation for out of tolerance straightness is referred to in the trade as camber or sweep; herein it will be called warp or warpage. Part of the process of producing steel product involves cooling the hot shaped steel to a temperature where the steel is dimensionally stable and/or can be stored. As is known, the rate at which steel cools has a significant affect on the properties of the steel due to, in part, the affect the rate of cooling has on the grain structure of the resultant steel product. Uneven cooling tends to produce stresses in the steel and such stresses may cause the steel product to warp or crack or otherwise suffer damage. When some coils are produced, it is necessary to retard the rate of cooling to prevent damage from stress. Special furnaces or other devices such as covers are used to control the rate of heat loss and temperature reduction.

A somewhat similar problem can be caused by hydrogen entrapment in the metal. When hydrogen is trapped in miniscule voids in the metal it can lead to a phenomenon known as hydrogen embitterment. This can result in localized weakness and cracking of the metal if the hydrogen is not removed. Hydrogen and other gasses are often removed using special degassing equipment. They can be vacuum, magnetic stirring or argon stirring. Stirring is used because the liquid metal surface has less head pressure and can more easily release the entrapped gasses.

Therefore, substantial resources are devoted to ensuring the hot shaped steel cools at a desired rate. Often the hot shaped steel is controllably cooled on a cooling bed. Cooling beds, depending on the dimensions of the steel product, and the desired rate of cooling, can be quite long and can add significant cost to the production of steel because of the upfront capital expenditures required to create the necessary facilities. Sometimes the size of the cooling bed is a limiting factor in determining the rate at which the steel production facility can operate. In addition, the time needed to cool the steel increases the amount of work in process. Naturally, increasing the amount of work in process increases the necessary level of inventory, which in turn decreases the efficiency of the plant operation. In addition, higher levels of inventory make the steel production facility less flexible and potentially less able to respond quickly to variations in the quality of the steel product. Thus, a decrease in the level of inventory would tend to make a steel production facility more profitable while potentially increasing the quality of the steel product produced.

For example, as is known in the art, when the steel product is a steel bar, the steel bars are first sufficiently cooled and then bundled together via straps and removed from the production line and typically placed in a storage facility until the steel product is transported to the customer. If the steel bars are bundled too soon, the interior portion of the bundle will cool at a slower rate than the exterior portion of the bundle. Also, the portion of the steel bar that is exposed to the outside air will cool more rapidly than the portion of the steel bar that is in contact with other bars. Thus, the exterior steel bars of the bundle will have internal stresses as a result of the disparate cooling rates. These stresses can cause the steel bars to warp once the straps holding the bundle together are removed, potentially making the steel bars unusable.

Longer cooling beds relieve this problem but, as discussed above, are costly and inefficient to implement. As can be appreciated, general storage facilities are somewhat less costly to install and maintain as compared to cooling beds. And the storage facilities are usually a necessary requirement anyway. Thus, storing the steel in a storage area while the steel cools would be less costly from a facility investment perspective and this decreased cost could significantly benefit the profitability of the steel production facility. Therefore, it would be beneficial to be able to bundle the steel bars sooner (i.e., while still quite hot) without having to later rework the steel bars due to warpage caused by internal stress concentrations affecting the dimensional straightness of the steel bars.

Once the steel product is delivered to the customer, the steel product is typically further processed to make finished goods. The processing can include machining the steel, drilling, punching, grinding, cutting, welding, cold working the steel, and various other known methods of processing steel into finished goods. During this process of working the steel, the initial internal forces are often unbalanced in the steel product. These forces tend to create localized stress concentrations in the finished good. As can be appreciated, a particular grade of steel can only withstand a particular level of stress before the steel deforms in an undesirable plastic manner. Thus, it is undesirable to have excessive internal stresses in the steel product prior to the steel product being processed into the finished good, because this additional processing can cause the internal stresses to distort the final product.

Depending on the desired properties, even the localized stresses created by the processing of the steel product into the finished good may be undesirable. Therefore, various methods of relieving the stresses of finished goods are known. One method is to let the finished good sit for a substantial time so that the excessive internal stress concentrations have time to relax. Another method is to heat the finished good so that the internal stress concentrations can more quickly be relieved. Another method is to vibrate the finished good in a known manner, the vibrations providing energy that allows the stress concentrations to more quickly dissipate. While these methods of reducing the resultant stresses in the finished product are sometimes necessary, it is undesirable for significant variations in the stress concentrations to exist prior to the processing of the steel. Therefore, it would be advantageous to ensure the steel product, before being further processed, is essentially free of internal stresses or at least has a relatively constant internal stress level throughout the steel product.

BRIEF SUMMARY OF THE INVENTION

In an embodiment, the process of making steel bars includes the shaping of semis with a rolling mill. The bars, after being shaped by the rolling mill, are directed via a conveyor to a shearing, straightening and bundling station. The bars are then bundled while still at an elevated temperature. In an embodiment, the cut-to-length and bundled bars can be removed from the bundling station and allowed to cool in a separate location such as in a storage facility. Once sufficiently cooled, bundled bars are then vibrated to reduce internal stresses. The bars can then be unbundled without concern that internal stresses will cause the bars to warp. Thus, it is possible to reduce the size of the cooling bed so that the cost of building a steel production facility can be reduced.

With the invention, in an embodiment, the rate of production through an existing steel production facility is greatly increased by allowing steel to move more quickly across the existing cooling bed because the requirement to wait for cooling to take place is reduced or eliminated by ignoring the stresses and then relieving those stresses at a later time. In this way, the cooling bed capacity is not the limiting factor on the rate of steel production, as is sometimes the case.

With the invention, in yet another embodiment, the coils of steel strip are allowed to cool and then vibrated so that stresses are relieved. These stresses ordinarily cause the edges of the coiled strip to cool and contract more than the center of the strip, thus the edges can crack or the center of the strip can tend to bulge, when the coil is opened. Coils are often slowly cooled or even annealed and slow-cooled to help alleviate this situation.

In still another embodiment the coils are vibrated while cooling to dissipate stresses that would otherwise form. This allows for a faster cooling rate.

The metal can be vibrated while rolling or after rolling is completed. or while undergoing intermediate cooling in between rolling passes. In some cases the surface is quenched and cooled while the interior is still hot. This can result in superior surface properties and grain structure, however stresses can also be induced. Vibration can reduce these associated stresses.

In a further embodiment, the metal is vibrated while it is being hot or cold worked. This removes some of the stresses and also increases the forces applied to the work by the mill rolls, cold working dies, forges or presses. The mill rolls, cold working dies, forges or presses are themselves vibrated while processing the work. This makes the material displacing forces more effective. The forces generated by the vibration are added to the working pressures, thus further displacing the metal while also relaxing some of the localized stresses. The vibration sources can be mechanical or electrical or magnetic or electro-magnetic.

With the invention, in the case of coiled steel rod or wire, the coils are cooled in a series of loose loops as they pass along a cooling conveyor and sometimes through a quench tank of liquid coolant. The loose loops are then coiled on a mandrel and wire tied or strapped together. These coils also have stress concentrations where the loops are resting on each other as they move along the cooling conveyor line. The stresses can be relieved by vibration techniques and methods of the invention as described herein, during or after cooling.

In yet another embodiment, magnetics may be used to relieve the undesired internal stress concentrations within the steel products.

In a further embodiment, vibration can be used to remove unwanted gases while the metal is in a liquid state, such as while in the melting furnace, ladle, tundish or mold (ingot or caster). Vibration can be used alone or along with conventional gas removal technology, such as vacuum degassing, argon stirring or magnetic stirring.

BRIEF DESCRIPTION OF THE DRAWINGS

The present invention is illustrated by way of example and not limited in the accompanying figures in which like reference numerals indicate similar elements and in which.

DETAILED DESCRIPTION OF THE INVENTION

The production of steel is a costly endeavor involving significant capital investment. Therefore, the amount of steel produced by a production plant needs to be quite large for the return on the capital investment to be positive. Thus, significant effort has been exerted to make the production of steel as streamlined and cost efficient as possible. It should be noted that while steel production is likely to enjoy the largest benefit from this invention given the volume of steel being produced, the production of other materials, including non-ferrous materials, having similar stress concentration issues could likewise benefit from this invention.

Figure 1:
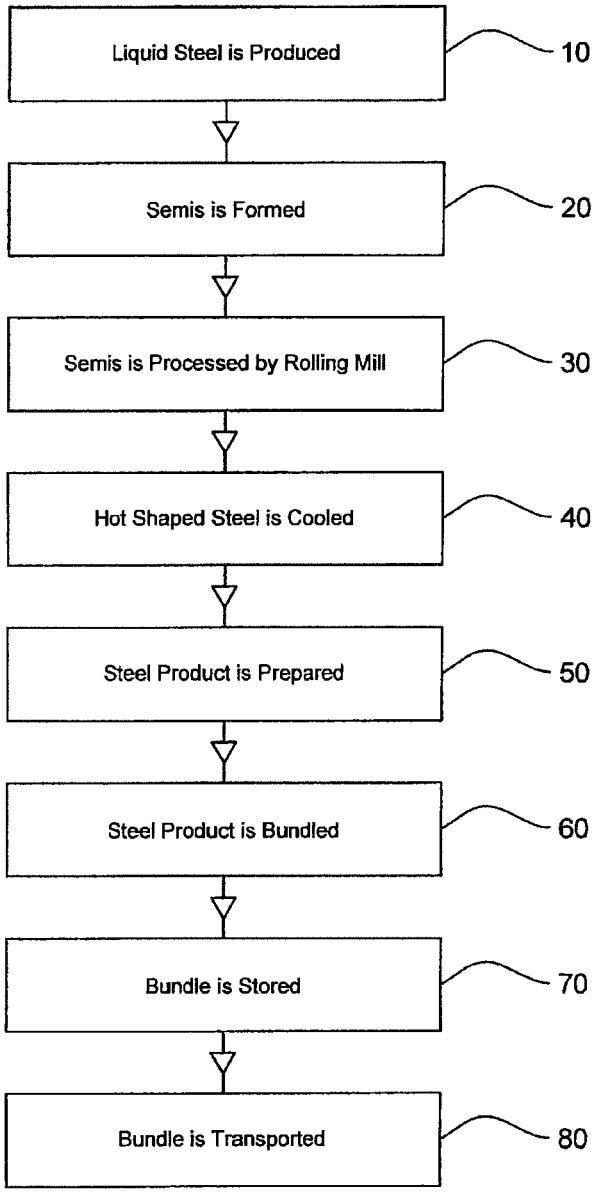
FIG. 1 depicts a block diagram of a typical production of steel product.

Turning to FIG. 1, a block diagram of a typical steel production facility is depicted. In step 10, the liquid steel is refined and the various other additives are introduced so as to produce the desired alloy. As is known, steel can have a varied composition. For example, stainless steel typically requires the addition of nickel and chromium.

Once the liquid steel is ready, it can be cast into semis, such as billets, in step 20. In step 30, the hot semis, are shaped by a rolling mill. Typically, the semis are reheated in a reheat furnace and a series of inline rolling mills are used to form the steel product. In an exemplary embodiment, the semis are shaped into long lengths of shaped bars. The bars can be in the shape of an angle, channel, beam, round, flat, oval, railroad track rails or any other suitable specialized shape for use in a final end product.

After being shaped, the hot shaped steel passes through a cooling bed in step 40; the cooling bed typically includes notched walking beams called rakes. The notched rakes help confine the bars to keep them from warping as they cool. Forced air or water can be used to increase the rate of cooling, with necessary attention given to metallurgical properties that may be altered by cooling.

In step 50, the long lengths of shaped bars are cut to the desired length and then run through a straightening machine to ensure the steel product is not warped. The steel product is then bundled is step 60. In step 70, the bundles are placed in storage until needed. Finally, in step 80, the bundles are transported, often to the customer. Transportation can be over short or long distances. Common means of transporting steel product over long distances include trucks, trains, and ships.

As discussed above, the term "bundle," is not limited to bundles of bars of steel product but also encompasses other shapes such as rolled coils of steel product and also stacks of plates and sheets. In general, the term "bundle" is used to reference an amount of shaped steel that can be conveniently held together. As used herein, the term "steel product" includes any bar, rod, strip, sheet, plate, band, hot-band, beam, channel, tube, pipe, track, rail, wire, and structural and special shapes (such as, bed rails, window frames, fence posts, and so forth), of any shape and configuration, and made of any type of metal.

Figure 2A:
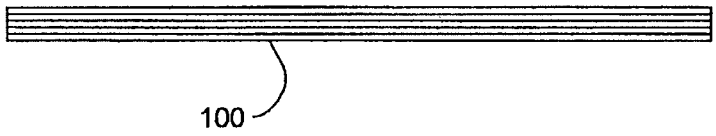
FIG. 2*a* illustrates a side view of a bundle of steel bars.
Figure 2B:
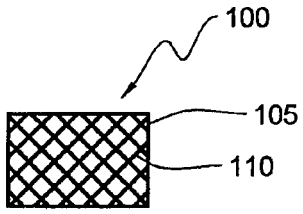
FIG. 2*b* illustrates an end view of the bundle of steel bars depicted in FIG. 2*a*.

FIG. 2*a* depicts an exemplary embodiment of a bundle 100 of steel bars. FIG. 2*b* illustrates a close up end view of bundle 100. As can be readily appreciated, if the bars are still hot, the exterior bars along the outer edge 105 of the bundle 100 will cool quicker than the interior area 110. Thus, the bars on the outer edge 105 of bundle 100 will be especially likely to have localized stress concentrations. In addition, the act of rolling the bars will tend to create internal stress concentrations within the bars. Thus, bars created via a rolling mill are quite likely to have unwanted localized stress concentrations.

Figure 3:
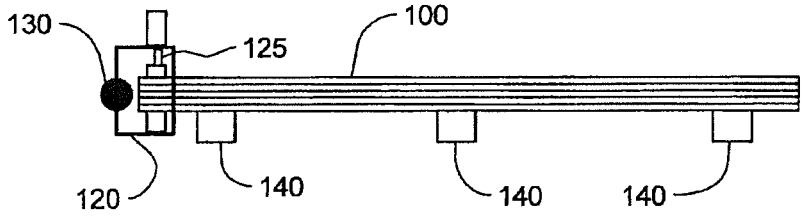
FIG. 3 illustrates a side view of the bundle of steel bars as shown in FIG. 2*a*, depicting an embodiment of a method of vibrating a bundle of steel bars.

FIG. 3 depicts an exemplary embodiment of the invention and includes the step of vibrating a bundle 100. A support frame 120 is mounted to the bundle 100 via a clamp 125. Connected to the frame 120 is a vibration generating device 130. The bundle is supported by a plurality of support blocks 140.

As depicted in FIG. 3, the vibration generating device 130 is portable. Thus, the system can be moved from bundle to bundle as desired.

Figure 4:
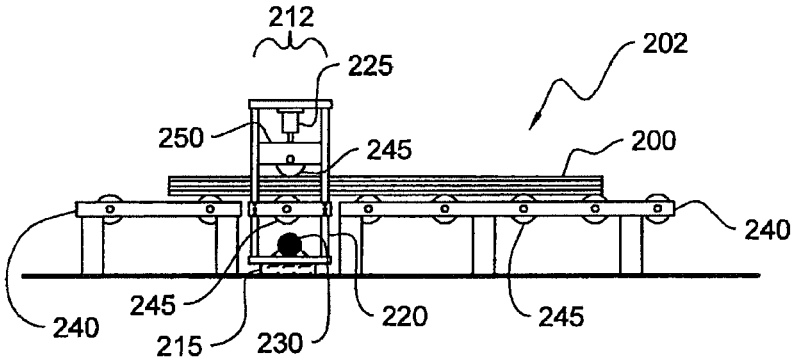
FIG. 4 illustrates an alternative embodiment for vibrating a bundle of steel bars.

Turning next to FIG. 4, an alternative exemplary embodiment of the present invention is depicted. A bundle 200 travels down a conveyer system 202. The bundle travels over a plurality of rollers 245 that are mounted on a conveyer roll support 240. As the bundle travels along, the bundle passes through a conveyer vibration section 212.

The vibration section 212 acts to vibrate the bundle while the bundle passes through the vibration section 212 so as to aid in reducing the internal stresses in the bars that make up the bundle. As depicted, the vibration section consists of a vibration isolator 215 that supports a support frame 220. Mounted on the support frame 220 is a force cylinder 225. The force cylinder 225 exerts a force on the movable support frame 250 that in operation exerts a force on a roller 245. In turn, the roller 245 mounted to the movable support frame 250 prevents independent vertical movement of the bundle 200 by restraining the bundle 200 between two opposing rollers 245. Mounted to the frame 220 is a vibration generating device 230. The vibration generating device 230 provides a vibration energy that is transmitted through the support frame 220 and the rollers 245 into the bundle 200.

As can be appreciated, the time it takes the bundle 200 to travel through the vibration section, along with the amount of vibration energy supplied by the vibration device 230 determines the effectiveness of relieving internal stress concentrations.

Figure 5A:
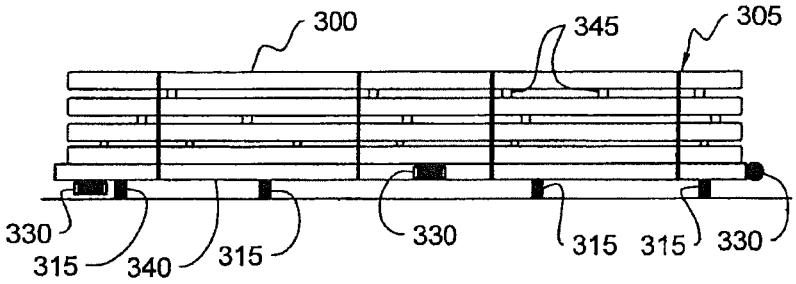
FIG. 5*a* illustrates a side view of another alternative embodiment of a method for vibrating a bundle of steel bars.
Figure 5B:
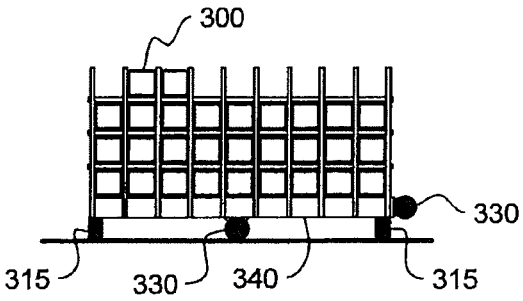
FIG. 5*b* illustrates a front view of the embodiment depicted in FIG. 5*a*.

Another exemplary embodiment of the present invention is depicted in FIG. 5*a* and FIG. 5*b*. As depicted, a plurality of bundles 300 is held in a storage rack 305. The rack includes a frame portion 340. The frame portion 340 is supported by vibration isolators 315. As depicted, mounted to the frame portion 340 is a plurality of vibration generators 330, each having the capability of providing different vibration forces or energy to the rack, or that the vibration force of one generator is not ordinarily aligned with the vibration force of a second generator, unless it is desired to augment the vibrations from the second. In between the plurality of bundles 300 are support blocks 345. Support blocks 345 facilitate the addition and removal of bundles 300 and also serve to transfer vibration energy between adjacent bundles 300.

In an embodiment, a plurality of bundles of hot steel product is placed on the rack. The bundles are then cooled. The cooling can be via application of a cool liquid or a blast of air. In an alternative embodiment, the bundles can be cooled by allowing them to reach near ambient temperature through conventional heat transfer between the hot bundles and the cooler ambient air and surroundings. Vibrations are then applied to the frame portion 340 via the vibration generators 330. In an embodiment, the level of vibration being applied to the frame portion 340 is lower than the vibration energy being applied during the conveyer method. Metal castings, for example, typically are allowed to age for an extended period of time so that the stress concentrations have time to be naturally relieved by seasonal changes in temperature and the like. The above embodiment allows for similar stress relief but on a much faster scale, such as within hours or days instead of months or a year.

Figure 6:
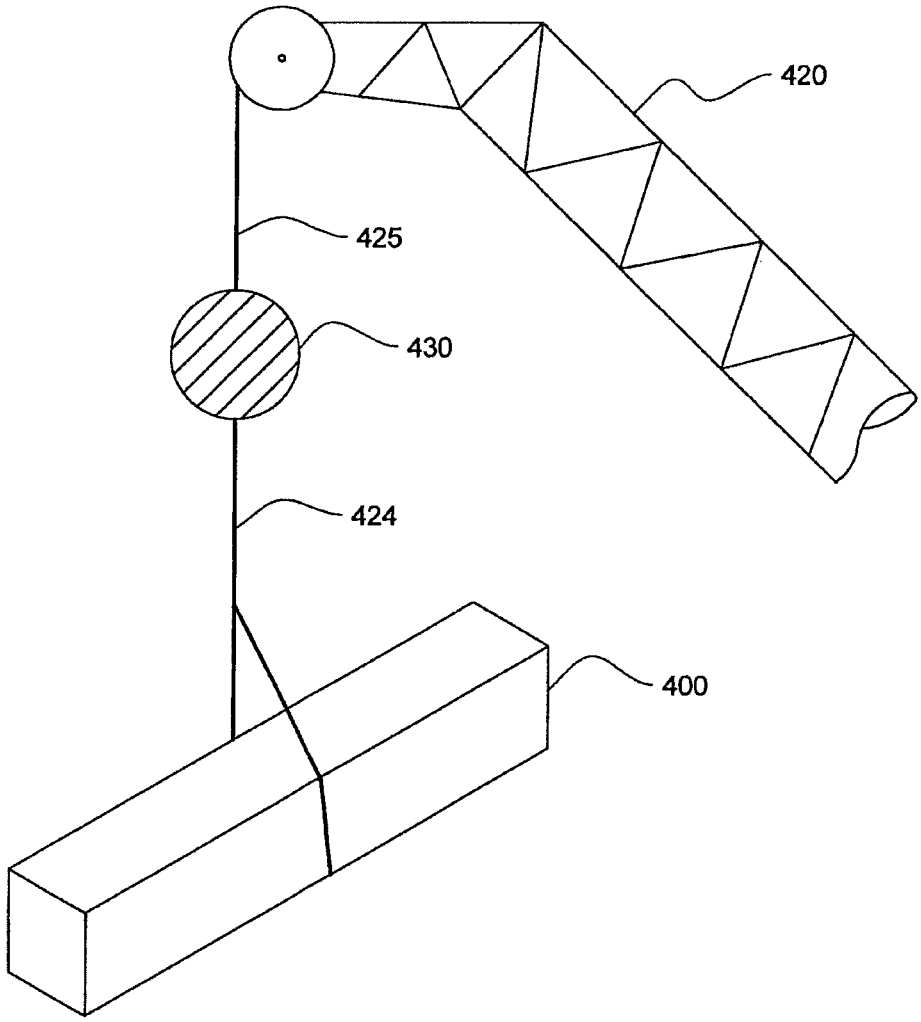
FIG. 6 depicts yet another alternative embodiment of a method for vibrating a steel product.

FIG. 6 depicts another exemplary embodiment of the present invention. As depicted, a bundle 400 is supported by a crane 420 via a cable 424 or chain or rigid member. A vibration generating device 430 supports the cable 424. The vibration generating device is supported by a cable 425 which is in turn supported by crane 420. A vibration isolator, similar to the vibration isolators described above, is located between the crane and the vibration generation device to protect the crane from unwanted vibration. Thus, the vibration generating device 430 can be used to vibrate the bundle 400 while the bundle 400 is being transported. In this manner, the bundle 400 can experience stress relief without the need to separately vibrate bundle 400 at some other location. Naturally, when vibrating the bundle 400 during transportation between a first and a second location, it is preferable that the bundle 400 be sufficiently cooled so as to avoid further accumulation of internal stress as a result of later cooling. Other types of cranes or mobile carriers would use a similar arrangement to that shown, including cranes such as overhead traveling cranes, or specialized mobile carriers as typically used in steel mills and steel warehouses. Vibrators and isolators would be suitably mounted to the transporter to allow the bundles to be vibrated in transit.

Figure 7:
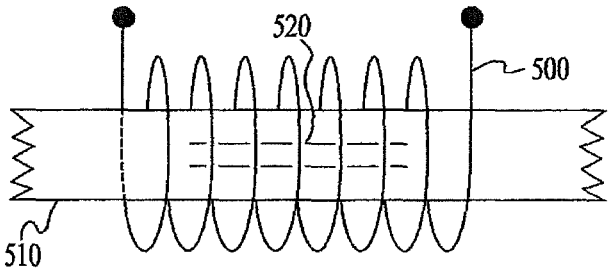
FIG. 7 depicts a solenoid coil for relieving stress in a steel product.

FIG. 7 depicts another exemplary embodiment of the present inventions. In this embodiment, magnetics may be used to vibrate steel or other metals. In this embodiment, an alternating electric current will create an alternating magnetic field around an electrical conductor 500. This conductor 500 may be wound in the form of a solenoid coil. The resulting field may be intensified by the multiple windings of the coil. A magnetic material such as steel 510 can be placed in the hollow center core 520 of the solenoid coil. The steel 510 will become magnetized, first in the forward direction and the in the reverse direction as the current is alternated. If the current is alternating at 60 Hz, as is common in the United States, the magnetic field will reverse 120 times per second because the magnetic poles reverse at this rate.

Figure 18A:
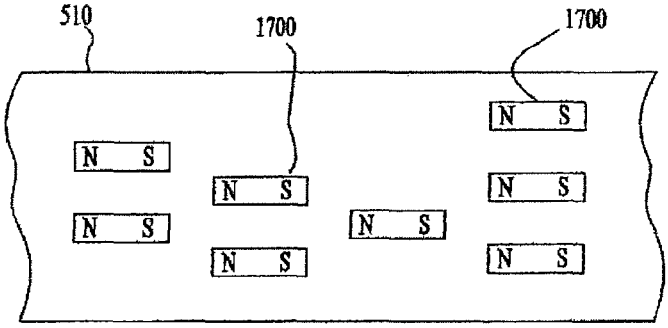
FIG. 18*a* illustrates a magnetically susceptible material having aligned magnetic domains.

Referring to FIG. 18*a*, when steel 510 is magnetized it changes shape minutely because of the phenomenon of magnetostriction. As a result of magnetostriction, a magnetized item becomes slightly smaller than its non-magnetized counterpart. This is a result of the magnetic forces present inside of the magnetized material pulling the magnetic domains 1700 closer together, thus reducing the overall dimension.

Figure 18B:
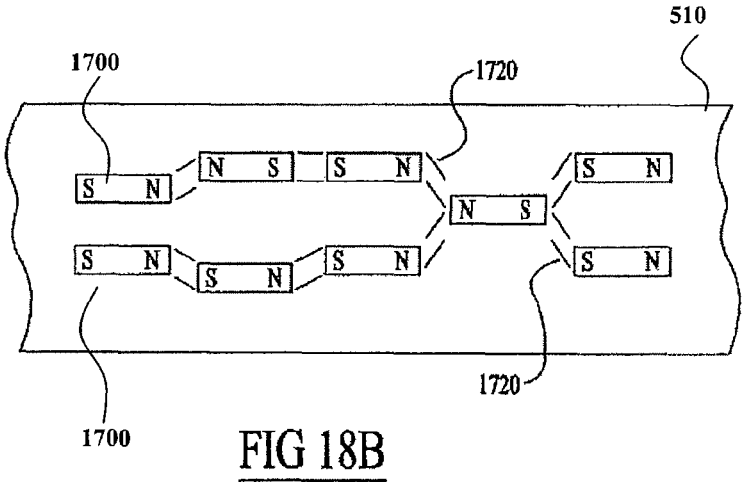
FIG. 18*b* illustrates the magnetically susceptible material having opposing magnetic domains.

Referring to FIG. 18*b*, when steel 510 is immersed in a magnetic field it becomes magnetized. When the magnetizing source is removed, a certain amount of residual magnetism will remain in the steel 510. This causes hysteresis. If a magnetic field of opposite polarity is applied to the steel 510, the steel 510 will be repelled by this new, opposing, magnetic field 1720 until the strength is great enough to overcome and reverse the hysteresis. Whereupon, it will be attracted, once again and magnetized in the opposite polarity.

While the hysteresis is being removed and the field reversed, some of the internal magnetic domains 1700 inside of the steel are being mutually repelled by the opposing magnetic field 1720. This causes the steel 510 to become slightly larger, for an instant, and then to become smaller again as the forces of attraction take over.

The application of this alternating field will result in the expansion and contraction of the steel 510, or other metallic material. The cyclic expansion and contraction causes, or is a form of vibration. This vibration is created and located inside of the steel. One benefit of this type of vibration is that it is not necessary to transfer it into the steel 510 mechanically. The magnetically induced vibration can be uniformly applied to the entire specimen, rather than locally as may be the case with mechanically induced vibration.

Figure 10:
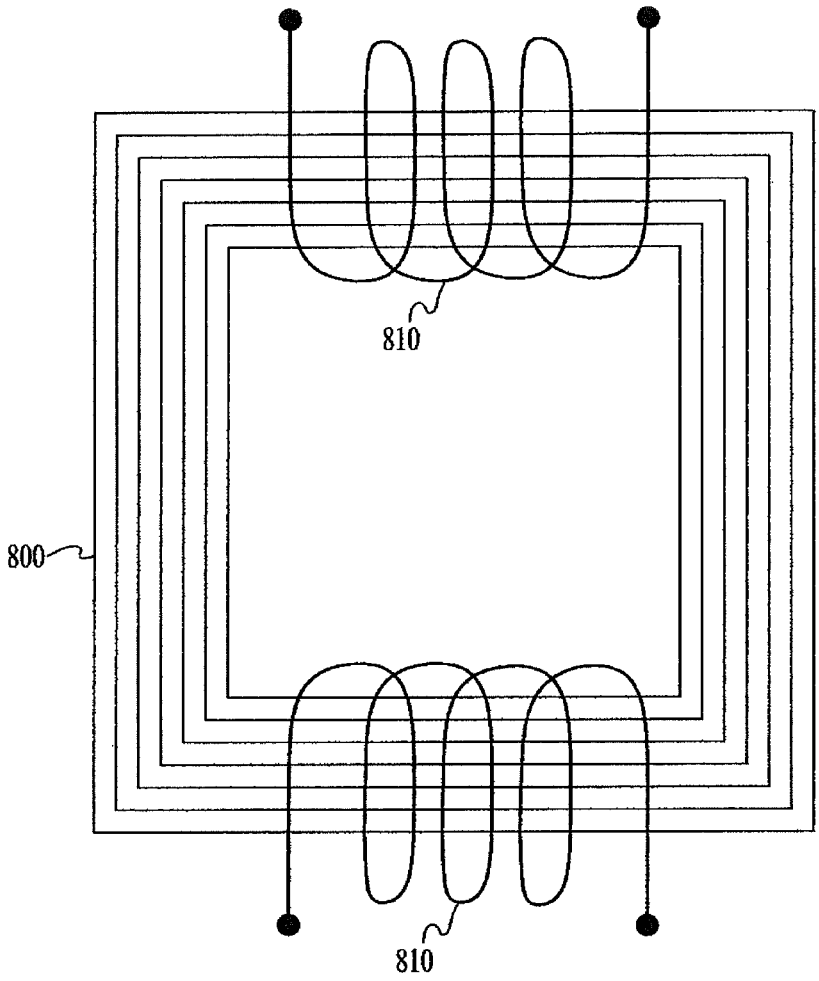
FIG. 10 is a schematic of an electrical transformer.

Referring to FIG. 10, electrical transformers are typically constructed with laminated pole pieces 800 made of "electric steel". The objective of the laminated pole pieces 800 is to minimize eddy current heat generation in the steel, or to keep it minimized. In a broad sense a bundle of long steel product such as angles or bars can be compared to a laminated transformer core. The angles or bars can be subjected to variable magnetic fields, from one or more interacting current carrying coils, and caused to vibrate in a beneficial manner without generation of damaging eddy currents. Magnetically induced vibration is often noted in commercial and industrial transformers, especially when they are electrically loaded. It is commonly known as a 60 cycle hum or electrical hum. As noted earlier, it is audible as a 120 cycle noise since it reverses at twice the fundamental frequency. The main source of the 60 cycle hum is the expansion and contraction of the electrical steel in the laminated pole pieces 800 that are used to transmit energy magnetically from one electrical coil 810 to another electrical coil 810 on the other side of the transformer. FIG. 10:

The vibration created by reversing the magnetic field can be tailored to optimize stress removal by adjusting the frequency and amplitude to suit the specific conditions of the material. Among other things, these conditions could include steel chemistry and shape. For example higher carbon steel can require higher frequencies to remove internal stresses, such as the case with mechanically induced vibration. Differences in material shape can require variations in frequency. For some materials it is beneficial to use a frequency that causes the material to resonate, thus causing greater displacement of the grain structure with lower energy inputs.

Figure 8:
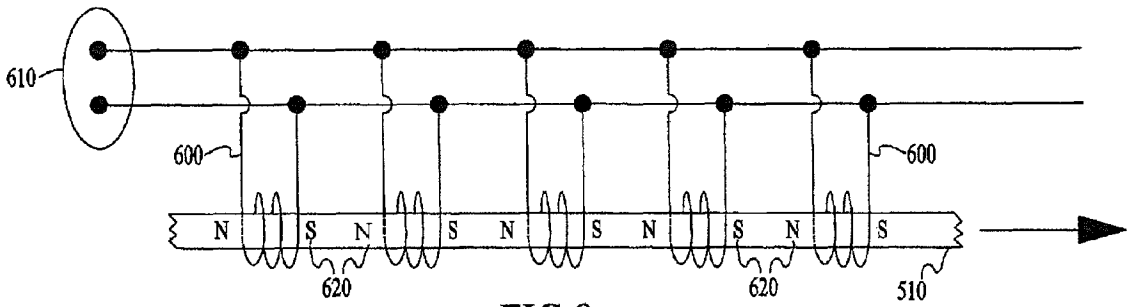
FIG. 8 depicts a series of solenoid coils arranged around a steel product to remove stress in the steel product.

FIG. 8 depicts one of the several ways to use magnetics to generate fields inside of the steel 510 to be treated. The steel 510 can be passed through one or more suitably sized solenoid coils 600. An electric current source 610 is applied to the solenoid coils 600. The current 610 can be alternating current at an optimum frequency. If the steel 510 is moving rapidly through the coils 600 then the frequency of the current 610 can be adjusted to compensate for the velocity of the steel 510.

In those cases where the velocity of the steel 510 is correctly matched to the desired steel treatment frequency, it is possible to use DC current in the solenoid coils 600 instead of AC. The solenoid coils 600 are electrically connected so the steel 510 is subjected to a series of north-south pole arrangements 620 so that the induced magnetic fields inside of the steel 510 are reversing as the steel 510 is conveyed through the solenoid coils 600.

Figure 9A:
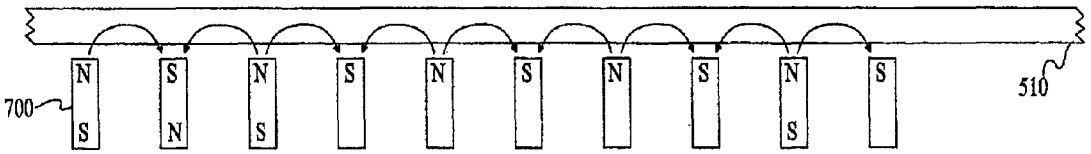
FIGS. 9*a, b, c* illustrate magnets used to induce magnetic fields into the steel product.
Figure 9B:
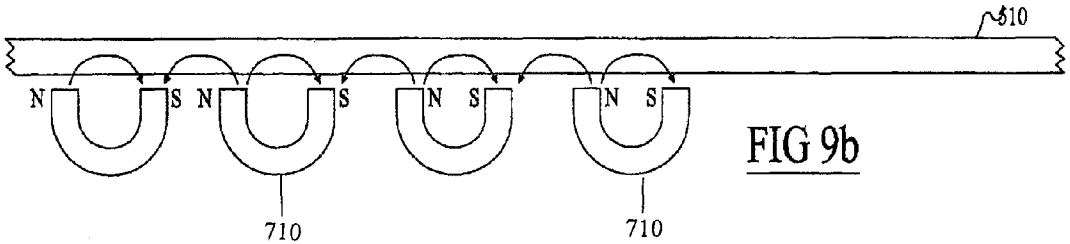
Figure 9C:
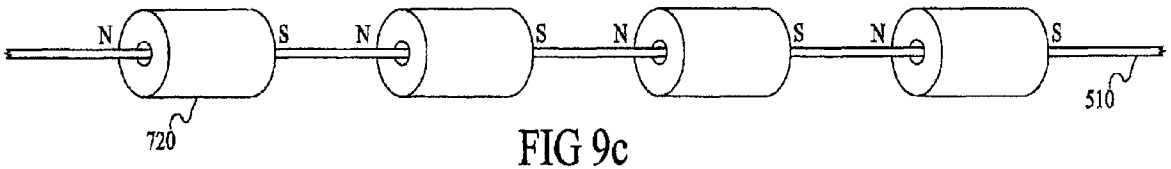

Referring to FIGS. 9 *a, b, c*, in a somewhat similar arrangement, and for some applications, permanent magnets can be used instead of electromagnets. In this embodiment, the steel 510 being treated is passed through the magnetic fields in a manner similar to that described above. These magnets can be any applicable shape, such as a bar 700, as depicted in FIG. 9*a*, horseshoe shaped 710, as depicted in FIG. 9*b*, or tubular 720, as depicted in FIG. 9*c*. In this embodiment, the entire work piece, e.g. steel 510, can be stress relieved as it passes through the applied magnetic fields.

Figure 11:
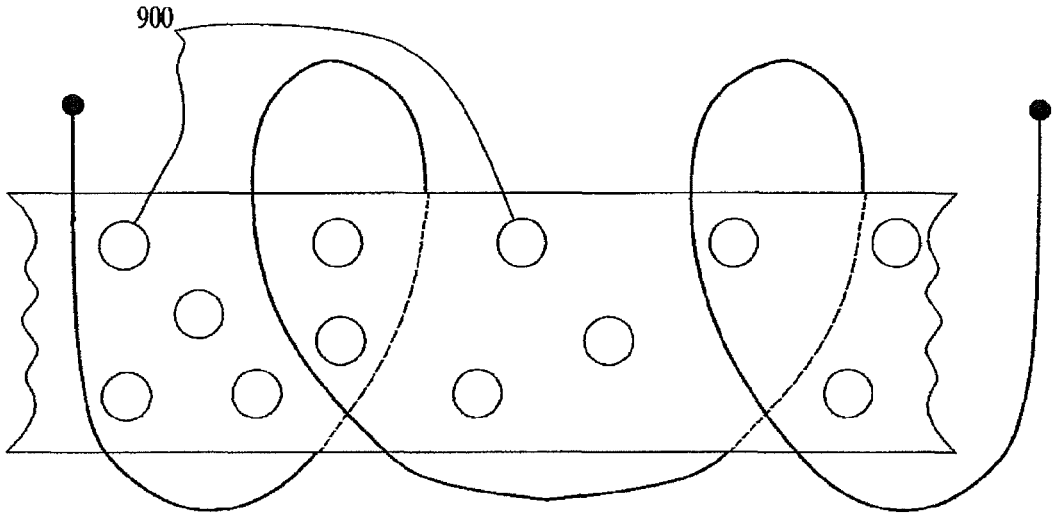
FIG. 11 illustrates a solenoid coil inducing eddy currents into a steel product.

Referring to FIG. 11, for the case of non-magnetic metals such as some stainless steels, aluminum, copper, or steel above the Curie Point, eddy currents 900 can be induced into the metals by external magnetic fields in a manner similar to that described above. These eddy currents can be established so that their localized magnetic fields are interacting and causing magnetostriction with resultant vibration and stress removal. Some heat generated by the eddy currents can enhance the effect of the vibration.

In some cases where excess heat may be detrimental, the heat must be controlled. This can be accomplished by the use of air cooling and/or water or other liquid cooling. Alternative methods of controlling hear are the work can be immersed in a bath of liquid to absorb the heat; the magnetic fields can be applied intermittently to allow the work to cool in between applications; and the intensity and frequency of the current can be adjusted, all depending on many various factors, such as type of material and shape.

In some cases, magnetic field generators can be located on the production equipment to produce magnetostriction and stress removal while the metal is being processed. These generators can be located before, during and/or after casting, rolling, cooling (as on a cooling bed for example) or finishing, cold drawing or while being conveyed or in storage.

Figure 12:
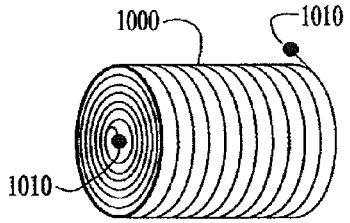
FIG. 12 depicts a coil of steel product having ends accessible to a current source connector.

As depicted in FIG. 12 another method for generating a beneficial magnetic fields is to pass a current through a steel coil 1000, such as coiled rod or coiled rebar so that the steel itself becomes a solenoid conductor. The ends 1010 of the steel coil 1000 are connected to a current source. The current flows through the steel coil 1000. The current has an associated magnetic field. The current is alternating, or pulsed, so that the magnetic fields surrounding the loops of coiled steel 1000 are expanding and collapsing through the adjacent turns of the coiled steel 1000. This creates the desired vibration. The iron oxide mill scale on the bar surface acts as a partial insulator between the loops. For coated steel and plastic coated rebar, for example, the plastic coating can act as an insulator between the loops of the coiled steel 1000. In other cases the coiled steel 1000 may have an oiled surface, or immersed in an oil bath to partially electrically insulate (and cool) the loops, if needed. One or more coils can be electrically connected in parallel or even in series. They can be physically positioned so that their magnetic fields react beneficially.

A similar arrangement can be used for coiled strip by connecting the electrical current conductor clamps to the interior wrap of the coil and to the exterior wrap, so the current flows through the entire length of the coiled strip. Here, again the oxidized or oiled surface acts as a partial insulator between wraps or layers.

Figure 17A:
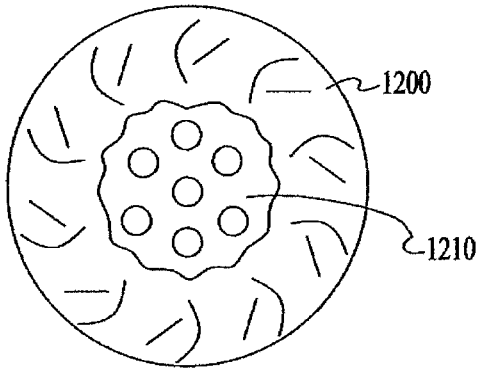
FIG. 17*a* depicts a cross-section of cold worked round steel product.

FIG. 17*a* illustrates a cross section of a cold worked wire rod or bar 1250. Cold worked materials are especially difficult to stress relieve with conventional mechanical vibrators. But, they can benefit greatly from stress relief. Cold drawn wire or rod, for example, has higher localized stresses on and near the surface 1200 than in the interior 1210. This is a result of the greater displacement of surface material while the wire is drawn through the dies. Typically, after cold drawing, part of the wire 1250 is then left under tension and the balance under compression, while the wire 1250 is at rest, with no applied loads. In a sense, it is already pre-loaded. This stress distribution has detrimental results when the wire is placed under tension, even before an external load is to be applied. As the load is increased, the tensile stressed area is less able to resist the load and will start to fail first. As the load continues to increase, cracks will appear and, with further load increases, the cracks propagate and the wire strand fails. Since the wire 1250 does not have uniform tensile strength through the cross section, the cross section cannot uniformly support the load. As a result, the cross section has to be made larger to compensate. In many cases the internal stresses of the section are unknown variables, even when coming from the same supply sources, and require additional design safety factors. If the section is relieved of the pre-stresses, so the stresses are uniform, then the tensile strength across the section will be more equalized. This treated wire 1250 is much more predictable and can be more accurately and safely sized to the load. Hoisting cable, tire wire and many other items are examples of applications that can benefit from greater predictability.

Figure 17B:
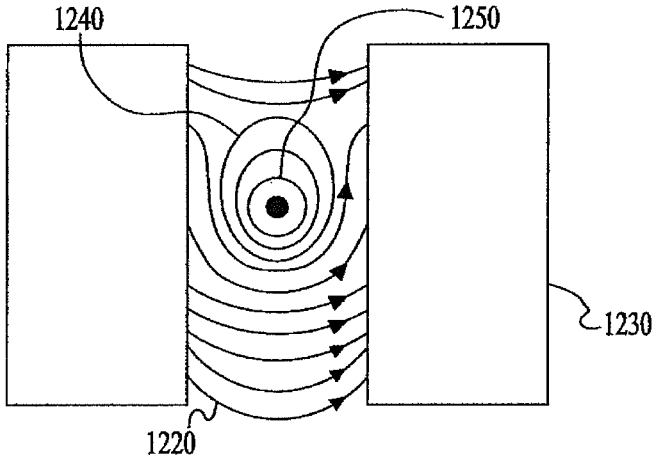
FIG. 17*b* illustrates a steel product undergoing stress relief while inside an interacting external magnetic field.

As shown in FIGS. 17 *a, b* in some materials such as cold drawn wire or rod 1250, it can be beneficial to apply higher frequency currents to the drawn wire or rod 1250. This takes advantage of the skin effect, where the higher frequency current tends to travel on or near the skin or surface 1200 of the cold drawn wire or rod 1250 where the stresses from cold drawing are much higher than in the interior 1210 of the cold drawn wire or rod 1250. The high frequency current with its associated expanding and collapsing magnetic field 1240, will remove some stresses. The current-carrying steel 1250 can also be passed through external magnetic fields 1220 that will interact with the fields associated with the wire's magnetic fields. The heating effect of the higher frequency on the wire surface will increase the stress removal there. The external fields can be from magnets 1230, solenoids or even adjacent conducting wires. The current can be applied to the work by way of the dies, rolls or through electrical collector shoes in contact with the work. The alternating current can be produced from a source that is rich in harmonics (frequencies that are multiples of the fundamental frequency). Higher frequency harmonics travel on or in the surface region so the effect is more pronounced there.

In another embodiment, instead of applying a current to the coiled rod or strip 1250, the coiled rod or strip 1250 can be shorted with an external conductor. The external conductor is connected to the start of the coil and to the end of the coil, so that there is a continuous, closed current path through the coil. This shorted coil is then placed in an alternating magnetic field so that current is generated in the coil by action of the magnetic fields as they cut the coiled turns or loops.

The depth of penetration of the magnetic fields is proportional to the frequency and intensity of the applied field. Higher frequency alternating fields will not penetrate as deeply as lower frequency. The depth of stress removal can be adjusted to selectively remove the unwanted stresses concentrated near the surface. The frequency can be varied so it selectively vibrates the entire cross-section so the properties are homogenous and uniform.

Other shapes besides wire are cold worked. For example, cold drawn round bars are often manufactured for use as shafting or axles. They also have non-uniform internal stresses. The surface is under greater stress than the interior. When a bending moment is applied to it is not able to support this added load as readily as it might if the internal stresses were uniform. The axle has to be oversized to accommodate for the defects. The same is true for other applications requiring uniform properties. Cold drawn bars are difficult to accurately machine because the internal stresses cause the bars to warp when some of the stressed surface is removed by machining. In many cases the desirable properties of the cold worked bars cannot be used because of the machining problems. Hot rolled materials are then often used as a second choice substitute, with compromised quality.

Some steels are machined to a specific shape and then are heat treated to a desired hardness. The heat treating distorts the machined part to such an extent that the part must undergo further grinding or special machining to restore it to the original shape. Specific vibrations during or after machining can reduce or eliminate the need for further machining.

Cold worked materials have many advantages, such as superior surface finish, more uniform straightness and greater dimensional precision. If the localized internal stresses are removed during manufacture these properties can be used to even greater advantage. The methods described herein may be the only practical means to do this. Normalizing and annealing are sometimes not options because they have detrimental effects on the desired and valued properties of cold worked materials.

Hot worked materials, such as structural shapes also have disproportionately higher stresses near the surfaces because this is where the hot working forces (from mill rolls, forging hammers, etc.) are applied. If left untreated, these stresses can reduce the load bearing capacity in a similar manner to that described for cold worked materials. These materials have to be oversized as well to provide safety factors.

Figure 13A:
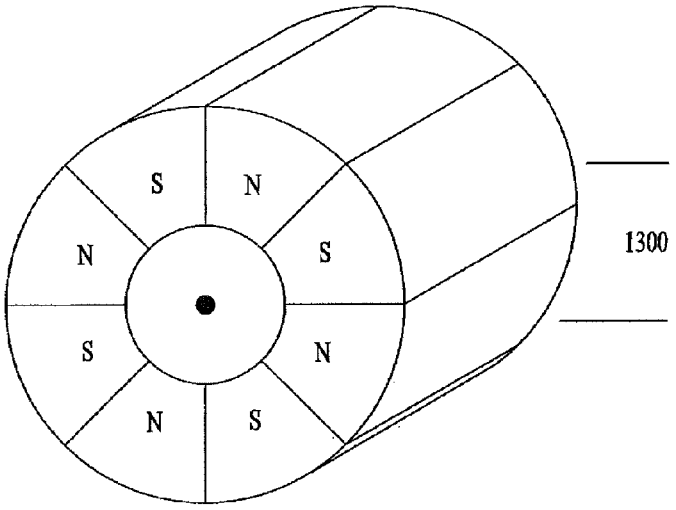
FIG. 13*a* depicts a magnetic roll with alternating north and south poles embedded in its surface.
Figure 13B:
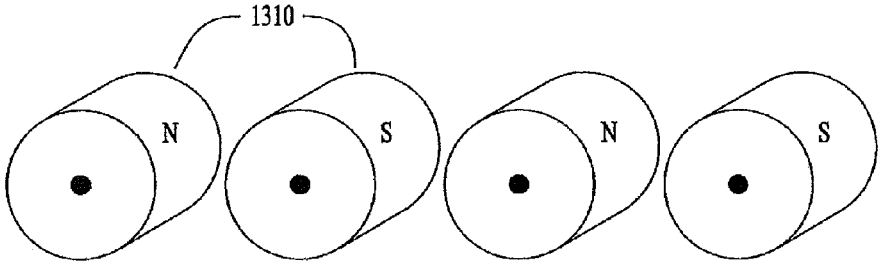
FIG. 13*b* illustrates a series of magnetic rolls.

Referring to FIGS. 13 *a, b*, in some applications it is possible to use conveyor rolls that have alternating north-south magnets 1300 embedded in them or are themselves magnets 1310, so that magnetic fields are induced in the metal while it is being conveyed.

Figure 14:
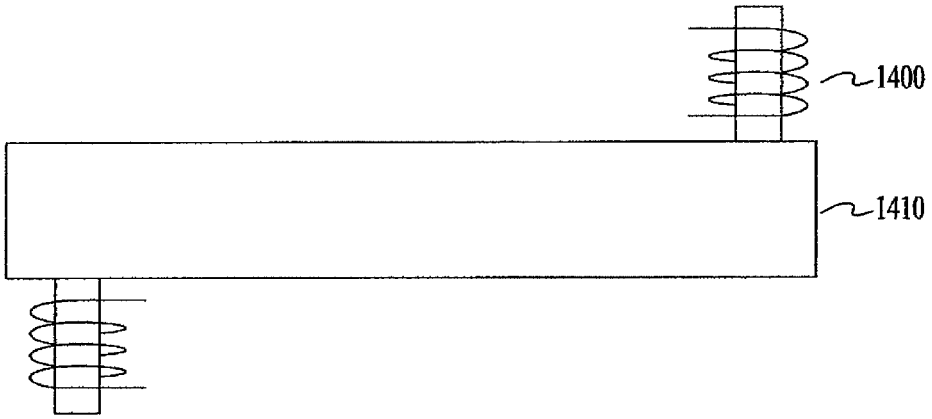
FIG. 14 depicts a steel specimen with magnets magnetically attached to the steel product.

As shown in FIG. 14, for other applications, use of the magnetic property of the solenoid to attach itself to steel can be utilized. In other words, the electromagnet 1400 will attach to the work 1410 when it is energized to generate the magnetic fields in the work being treated, reducing the need for a mechanical connection between the vibration source and the work.

Figure 15:
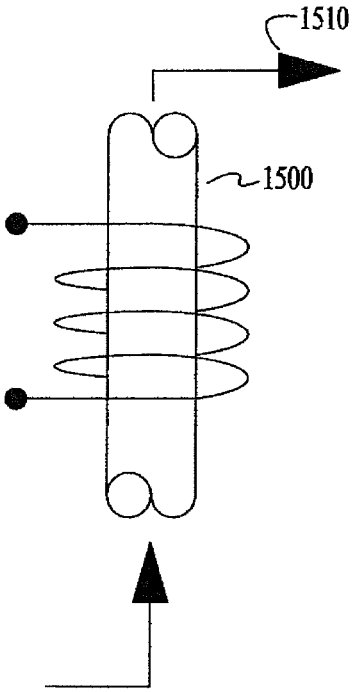
FIG. 15 illustrates a steel conduit, such as a water pipe or metallic hose, surrounded by a solenoid coil.

As depicted in FIG. 15, in those cases where it is not practical to directly apply magnetic fields to cause vibration in the work, magnetics can be used indirectly. They can vibrate the metal in process by generating vibrations in cooling water systems for example. This can be accomplished, for example, by magnetically vibrating the work 1500, such as cooling water pipes or flexible metal hoses, with the resultant vibrations then transferred by the water 1510 to the water-cooled components of the processing machinery, and thus to the work 1500. For example, a water-cooled caster mold can be vibrated with pulsing water flow, the vibrations thus transferred to the material while it is being cast or cooled. In a similar manner, water cooled skid plates, guides and rolls can be indirectly vibrated by the magnetic sources. The conduits for cooling water for sprays can also be magnetically vibrated so the water jets are caused to pulsate and thus to vibrate the metal. Mechanical means can also be used to generate vibrations in the water systems with similar results. For example, quench tanks can be magnetically or mechanically vibrated with the vibrations then conducted to the work by the vibrating water. Pulsations can be created in water cooling systems by a variety of means, including piston pumps.

Figure 16A:
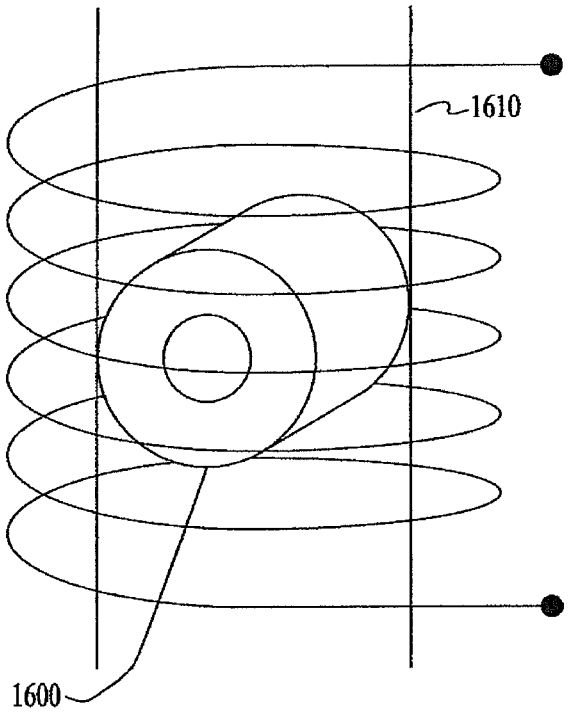
FIG. 16*a* depicts a large steel product inside of a solenoid core.
Figure 16B:
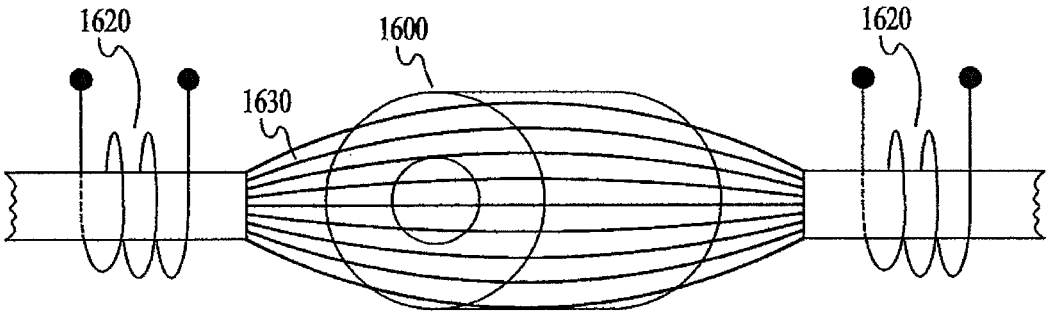
FIG. 16*b* illustrates a large steel product placed between two solenoids.

Referring to FIGS. 16 *a, b*, for large bulky steel items, the steel 1600 can be placed inside of a suitably sized solenoid core 1610. This might be the case for a large coil of strip or hot band, or even a casting or weldment. Alternately, the steel 1600 can be placed between two solenoids 1620 and subjected to the magnetic fields 1630 concentrated between the two solenoids 1620. As is the case with mechanical vibration, previously described, the work can be treated with magnetic vibration for an optimum length of time while it is in storage or between processes.

To prevent unwanted residual magnetism in the steel, following stress relief, the applied alternating magnetic fields can be gradually reduced so the work is then degaussed.

Magnetic stress relief can be especially beneficial for cold worked materials because the variation in internal stresses can be equalized. When the stresses are equalized the section is able to support a greater load because the localized stresses are no longer present. The areas containing greater stresses will fail first when a load is applied because they are already preloaded by the internal stresses and so cannot carry as great a load as those that are free of stress to start with.

Some metals are susceptible to hydrogen, nitrogen, oxygen and other gas entrainment. Hydrogen is problematic because it can lead to embitterment. Elevated temperatures can sometimes be used to cause the hydrogen within the solid metal to diffuse out of the metal. Vibration can be used to remove it, as well, with or without added heat or while cooling. As is the case with stress removal, vibration induced hydrogen removal can take place at many locations during the manufacture of metal while using very similar methods to those for stress removal. In a novel way, vibration can be used to remove unwanted gases while the metal is in a liquid state, such as while in the melting furnace, ladle, tundish or mold (ingot or caster). Vibration can be used along with conventional gas removal technology, such as vacuum degassing, argon stirring or magnetic stirring. Entrained gasses in the ladle have been known to suddenly release and unexpectedly force the molten metal to erupt and overflow the ladle, resulting in severe injury and death.

Along with gas removal, vibration can be used encourage non-metallic inclusions, such refractory pieces and oxides and sulfides, to float to the surface. These inclusions, if left in the metal can cause defects in the metal structure that also make it unpredictable and prone to failure. The sources of vibration for these various applications can be mechanical, electro-magnetic, via the cooling water systems or from numerous other sources that are suitable for the particular metal and operation.

The present invention has been described in terms of preferred and exemplary embodiments thereof. Numerous other embodiments, modifications and variations within the scope and spirit of the appended claims will occur to persons of ordinary skill in the art from a review of this disclosure.

What is claimed is:

1. A method of producing steel product, comprising the steps of:

casting a semis from liquid steel in a mold to create a steel product, wherein the step of casting the semis further includes:

cooling the liquid steel;

providing water jets that provide a quantity of water;

pulsating the quantity of water from the water jets onto the semis while the liquid steel is solidifying so as to remove unwanted internal stress concentrations present in the solidifying or solidified steel.

2. The method of producing steel product of claim 1, wherein the semis is selected from the group consisting of a billet, bloom, slab, strip, hot-band, beam blank and near-net-shapes.

3. The method of producing steel product of claim 2, wherein the steel product is selected from the group consisting of a bar, rod, strip, sheet, plate, band, hot-band, beam, channel, tube, pipe, track, rail, wire, and structural and special shapes.

4. The method of producing steel product of claim 3, wherein the steel product is cast directly into strip on strip casters.

5. The method of producing steel product of claim 3, wherein hydrogen, nitrogen, oxygen and other gases are removed from the solidifying or solidified steel.

6. A method of producing metal product, comprising the steps of:

providing a supply of pulsating water;

casting a semis from liquid metal in a mold to create a metal product, wherein the step of casting the semis further includes:

cooling the liquid metal;

pulsating the water onto the semis while the liquid metal is solidifying so as to remove unwanted defect-producing inclusions present in the solidifying or solidified metal.

7. The method of producing metal product of claim 6, wherein the semis is selected from the group consisting of a billet, bloom, slab, strip, hot-band, beam blank and near-net-shapes.

8. The method of producing metal product of claim 7, wherein the metal product is selected from the group consisting of a bar, rod, strip, sheet, plate, band, hot-band, beam, channel, tube, pipe, track, rail, wire, and structural and special shapes.

9. The method of producing metal product of claim 6, wherein the metal product is cast directly into strip on strip casters.

10. The method of producing metal product of claim 6, wherein non-metallic inclusions, refractory pieces, oxides or sulfides are removed from the solidifying or solidified steel.

11. The method of producing steel product of claim 1, further comprising the step of pulsating the supply of water onto the mold while the liquid steel is solidifying.

12. The method of producing steel product of claim 1, wherein unwanted internal gas concentrations are removed from the solidifying or solidified steel.

13. The method of producing metal product of claim 6, further comprising the step of pulsating the supply of water onto the mold while the liquid metal is solidifying.

14. The method of producing steel product of claim 6, wherein unwanted internal gas concentrations are removed from the solidifying or solidified metal.

* * * * *